US008522458B2

(12) United States Patent
Gendreau

(10) Patent No.: US 8,522,458 B2
(45) Date of Patent: Sep. 3, 2013

(54) SNOWPLOW DISCHARGE CONTROL SYSTEM

(76) Inventor: Darrel M. Gendreau, Grand Isle, ME (US)

( * ) Notice: Subject to any disclaimer, the term of this patent is extended or adjusted under 35 U.S.C. 154(b) by 270 days.

(21) Appl. No.: 12/806,514

(22) Filed: Nov. 22, 2010

(65) Prior Publication Data

US 2012/0124868 A1 May 24, 2012

(51) Int. Cl.
*E01H 5/06* (2006.01)

(52) U.S. Cl.
USPC ..... 37/280

(58) Field of Classification Search
USPC ..... 37/234, 266, 280, 281, 270, 274–279; 172/143, 529, 784, 782, 247, 815; 239/1, 239/61, 69, 71, 172, 656, 675–681; 222/608, 222/626
See application file for complete search history.

(56) References Cited

U.S. PATENT DOCUMENTS 2,964,862 A * 12/1960 Lotz ..... 37/280
4,208,812 A * 6/1980 Brownly ..... 37/280
4,217,707 A * 8/1980 Karlsson ..... 37/280
4,356,645 A * 11/1982 Hine et al. ..... 37/281
4,614,048 A * 9/1986 Melby ..... 37/280
5,903,986 A * 5/1999 Parker ..... 37/281
6,104,980 A * 8/2000 Sato et al. ..... 701/50
6,173,904 B1 * 1/2001 Doherty et al. ..... 239/1
6,408,549 B1 * 6/2002 Quenzi et al. ..... 37/281
7,918,042 B2 * 4/2011 Ropog ..... 37/281

* cited by examiner

*Primary Examiner* — Robert Pezzuto
(74) *Attorney, Agent, or Firm* — W. F. Fasse

(57) ABSTRACT

A choke plate on a shaft is arranged at a discharge end of a snowplow blade and is rotationally driven, selectively to a closed position for blocking the discharge of snow from the plow blade, and an open position for allowing the discharge of snow. Switching between the positions preferably involves successive quarter turns of the shaft in a consistent rotation direction. A controller receives inputs from a manual control switch, a speed-dependent timer, and an external signal receiver, and accordingly controls the opening and closing of the choke plate. External wireless signals are provided by transmitters located before and after a driveway that joins into a road that is being plowed. The choke plate is automatically controlled to temporarily block the discharging of snow from the snowplow as the plow passes the driveway, to prevent the formation of a discharge snowbank across the mouth of the driveway.

15 Claims, 3 Drawing Sheets

SNOWPLOW DISCHARGE CONTROL SYSTEM

FIELD OF THE INVENTION

The invention relates to snowplows, and especially a system for controlling the discharge of snow from a snowplow.

BACKGROUND INFORMATION

In regions of the world that experience significant snowfall amounts, snow is typically cleared from streets and roads by trucks equipped with snowplows. A snowplow blade is mounted on the front of the plow truck via a mount arrangement that allows the snowplow blade to be tilted and lifted as required. In order to clear the right-hand driving lane, the snowplow blade is typically pivoted or angled to the right, so that the snow that is collected and pushed by the snowplow blade ahead of the truck is deflected and cast toward the right, to be discharged from the trailing discharge end of the snowplow blade (i.e. the right end in this case). The snow discharged from the discharge end of the snowplow blade forms a ridge or snowbank of accumulated snow along the right edge of the roadway. As the plow truck drives forward along the road, it will thus cast a continuous snowbank or ridge of snow, as long as there is snow on the road to be cleared, and the snowplow blade is lowered into the plowing position.

This continuous snowbank or ridge of discharged snow causes problems wherever side roads or driveways or the like (also simply called "intersecting roads" herein) join the road being plowed. Namely, the continuous snowbank formed by the snow discharged from the snowplow will continue without interruption across the mouth of the driveway or side road. Because it is formed by snow collected across the entire width of the snowplow blade, the resulting snowbank is generally significantly higher than the depth of the accumulated snowfall. Also, because the advancing snowplow tends to compact the snow, the resulting snowbank or ridge of discharged snow tends to be denser, harder and more solid than the accumulated snowfall. As such, the snowbank extending continuously across the mouth of the driveway or side road becomes a significant blockage and impediment to travel. Every time a snowplow passes by the mouth of the intersecting road, more snow will be added to the snowbank extending across it.

Such a snowbank extending across and blocking the mouth of a driveway or side road causes several problems. If the driver of a car or small truck attempts to traverse or drive through the snowbank in order to drive into or out of the intersecting road, then the vehicle may easily become "turtled", i.e. the undercarriage of the vehicle becomes at least partially stuck and resting on the snowbank, such that the drive wheels no longer get sufficient traction to propel the vehicle farther forward. The vehicle is then stuck halfway in the driveway (or other intersecting road) and halfway in the plowed road, thereby creating a potential traffic hazard.

In order to keep the snowbank cleared from the mouth of the intersecting road, it will be necessary to perform additional snow removal work on the intersecting road every time the snowplow passes by along the main road. This requires the homeowner or the responsible plowing service to repeatedly plow the intersecting road every time the plow truck passes by along the main road. Alternatively, the homeowner must shovel away the snowbank by hand using a shovel whenever the plow truck passes along the main road. At best, this causes significant additional expense and effort for repeatedly clearing away the accumulated snowbank, or in the worst case causes health risks such as heart attacks. It has been recognized that shoveling dense hard snow, such as the compacted snow of a snowbank discharged from a snowplow, is a significant cause of heart attacks.

The above problems are exacerbated if the plow truck on the main road is also spreading road salt and gravel, or if the initial snowfall is wet and heavy. Such wet snow, or snow partially melted by road salt, will later freeze, thereby forming a hard crusty ridge or bank of ice extending continuously across the mouth of the driveway or other intersecting road. Such a frozen snowbank is extremely difficult to remove by plowing or hand tools, and may be impossible to remove with a snowblower or the like. The gravel and ice chunks present in such a snowbank easily damage or clog a snowblower. Also, after such a snowbank melts, the gravel remains on the driveway and causes an unsightly and unsafe condition, because vehicles and pedestrians may slip on the accumulated gravel.

Even if the snowbank in the mouth of the intersecting road is removed each time the plow passes by, the snowbank extending beyond the edges of the mouth of the intersecting road still becomes progressively higher with each plowing throughout the winter. The accumulated snowbank on both sides of the mouth of the intersecting road thus becomes a visual obstruction that blocks the view of the road by a driver exiting the intersecting road onto the main road.

For the above reasons, it is desired to be able to intermittently stop the discharge of snow from the discharge end of a snowplow as it passes by the mouth of a driveway or side road or other intersecting road that adjoins the main road being plowed. For convenience and efficiency, it is also desirable to achieve such an intermittent control of the snow discharge from the snowplow in an automatic manner.

SUMMARY OF THE INVENTION

In view of the above, it is an object of the invention to provide a system for intermittently blocking and controlling the discharge of snow from the discharge end of a snowplow. A particular preferred goal or purpose of the invention is to avoid the formation of a snowbank or ridge of discharged snow across the mouth of a driveway or other intersecting road joining a road that is being plowed. Another object of the invention is to control such a system automatically as well as manually. Further according to the invention, the components of such a system shall preferably be robust, readily commercially available or easily fabricatable, and economical in price. The invention still further aims to avoid or overcome the disadvantages of the prior art, and to achieve additional advantages, as apparent from the present specification. The attainment of these objects is, however, not a required limitation of the claimed invention.

The above objects have been achieved according to one aspect of the invention in a snowplowing system comprising a snowplow blade, and a fully rotatable choke plate that is mounted at a discharge end of the snowplow blade and that is adapted for blocking discharge of snow from the discharge end when the choke plate is in a first (closed) rotational position and allowing discharge of snow from the discharge end when the choke plate is in a second (open) rotational position.

The above objects have further been achieved according to another aspect of the invention in a snowplowing system comprising a snowplow blade, a choke plate connected to and supported by a choke plate shaft, and a rotational actuator that is mechanically connected to an upper portion or a lower portion of the choke plate shaft. The upper portion of the choke plate shaft is rotatably connected to an upper portion of the snowplow blade near a discharge end thereof. The lower portion of the choke plate shaft is rotatably connected to a lower portion of the snowplow blade near the discharge end thereof. The choke plate is preferably rotationally symmetrical about the choke plate shaft and preferably has two opposite free edges that each respectively have a curvature which radially inwardly follows along a sectional curvature of the snowplow blade. The choke plate on the choke plate shaft is selectively rotatable to a first (closed) rotational position in which the choke plate extends substantially perpendicular to a longitudinal axis of the snowplow blade, and to a second (open) rotational position in which the choke plate extends substantially parallel to the longitudinal axis of the snowplow blade. The rotational actuator is adapted to rotate the choke plate successively selectively to the first rotational position and the second rotational position.

According to a further preferred feature of the invention, the first and second rotational positions of the choke plate are rotationally offset from one another respectively successively by one quarter turn in a single consistent rotation direction. Thus, the actuator merely needs to rotate in a single rotation direction, and can be a simple electric or hydraulic motor with a suitable gear transmission or the like. While a reciprocating partial rotation (back-and-forth) is alternatively possible, the full rotation in a single consistent rotation direction is considered to be simpler and smoother in operation.

The inventive system preferably further comprises a controller that is connected for control signal transmission to the rotational actuator and that is adapted to control rotation of the actuator to rotate the choke plate successively selectively to the first and second rotational positions. The controller preferably receives inputs from a manually operable switch mounted in the cab of the plow truck, a speed pickup that provides a signal indicative of the travel speed of the plow truck, and/or a wireless signal receiver that receives a first external wireless signal adapted to cause the controller to control the actuator to rotate the choke plate to the first (closed) rotational position. This first wireless signal is emitted by a first wireless signal transmitter mounted stationarily beside a road being plowed by the snowplow at a location upstream (relative to the plowing direction) from a driveway or other intersecting road. Thereby the first wireless signal automatically causes the choke plate to close and block the discharge of snow from the snowplow as the plow passes by the mouth of the driveway or other intersecting road. A second wireless transmitter preferably is located downstream from the intersecting road, and emits a second wireless signal that causes the choke plate to open and thus once again allow the discharge of snow when the snowplow has passed sufficiently beyond the mouth of the intersecting road.

Additional details and preferred features of embodiments of the invention will be described below.

BRIEF DESCRIPTION OF THE DRAWINGS

In order that the invention may be clearly understood, it will now be described in connection with example embodiments thereof, with reference to the accompanying drawings, wherein.

DETAILED DESCRIPTION OF PREFERRED EXAMPLE EMBODIMENTS OF THE INVENTION

Figure 1:
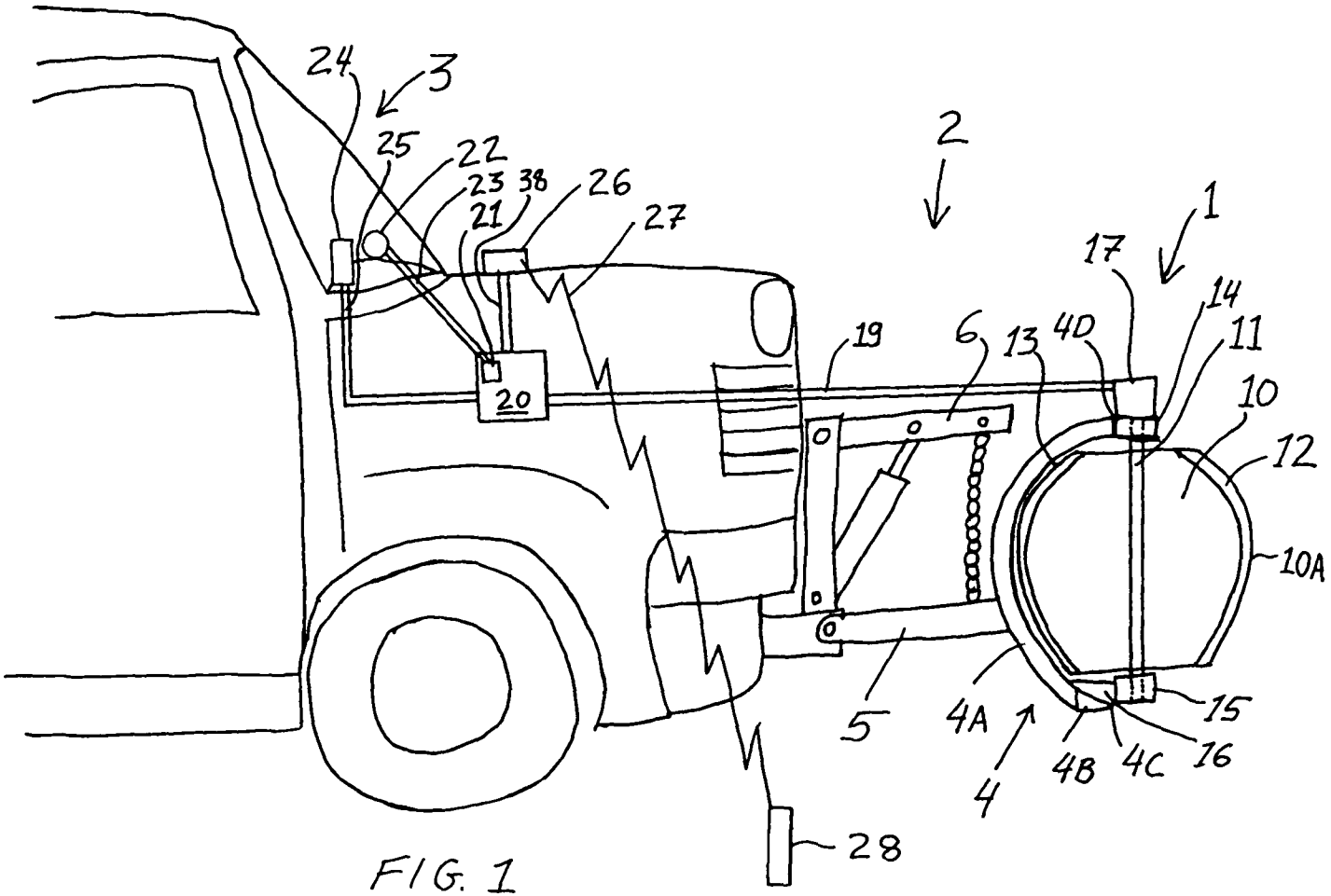
FIG. 1 is a schematic side view of a snowplow discharge control system according to a first embodiment of the invention, in combination with an otherwise conventional snowplow mounted on a plow truck.

FIG. 1 schematically shows a first embodiment of a snowplow discharge control system 1 provided on a conventional snowplow rig 2 mounted on the front end of a plow vehicle such as a plow truck 3. While FIG. 1 represents a small plow truck 3 such as a pickup truck for personal use or small commercial use, the inventive system is applicable to all sizes of snowplows ranging from small tractor-mounted plows up to large V-plows and fixed-angle plows used by municipalities, state and federal departments of transportation, airports and the like, for plowing main roads, highways, airport runways and taxiways, and the like.

The conventional snowplow rig 2 includes a plow blade 4 that is carried by a plow yoke 5, which may carry the blade 4 at a fixed angle swept back to the right or the left, or which may allow the pivot angle or discharge angle of the plow blade 4 to be adjusted as desired. The plow yoke 5 and the plow blade 4 are carried by a plow hoist or lift arrangement 6, by which the blade 4 can be raised up into a non-plowing transport position, or lowered down into a plowing position. The plow rig 2 is securely fixed to the front end of the frame of the plow truck 3. The plow truck and the plow rig may have any conventionally known features and configurations. For example, the plow blade 4 includes a plow blade body 4A, a replaceable bottom edge member 4B attached to and extending along the bottom edge of the blade body 4A, and a plow top edge 4D extending along the upper limit of the blade body 4A. The bottom edge member 4B terminates along a plow bottom edge 4C that faces forward and serves to shear and lift the snow off the road being plowed. Not shown are height adjustment shoes that may be provided to adjust the height of the plow bottom edge 4C above the road surface. The plow blade body 4A as well as the yoke 5 and lift arrangement 6 are typically fabricated of metal, but may include a plastic or composite plow blade body 4A with a metal frame or reinforcement members, for example.

A principle component of the inventive snowplow discharge control system 1 is a snow discharge choke plate or throttle plate 10 that is mounted to the plow blade 4 at or near the trailing discharge end of the plow blade 4. The choke plate 10 being mounted "near" or "proximate to" the discharge end of the plow blade means closer to the discharge end than the opposite end of the plow blade 4, and preferably within two feet from the discharge end, or especially at or directly adjacent to the discharge end. In the present example embodiment, the discharge end is the right end of the plow blade 4, which would be the typical case for a snowplow used to clear a main road with two-way traffic, i.e. with at least two lanes for travel in opposite directions.

The snow discharge choke plate 10 is carried on a choke plate shaft 11, of which an upper end or portion is rotatably supported in an upper rotation bearing 14, and of which a lower end or portion is rotatably supported in a lower rotation bearing 15. Thereby the shaft 11 and the choke plate 10 can rotate fully (i.e. make complete continuous rotations) about the axis of the shaft 11. In the present example embodiment, the upper rotation bearing 14 is mounted in a suitable support bracket or the like on the plow top edge 4D of the plow blade 4. Similarly, the lower rotation bearing 15 is mounted via a bracket 16 onto the replaceable edge member 4B along the plow bottom edge 4C of the plow blade 4. This represents a very simple manner of mounting the choke plate 10 onto a snowplow blade 4, so that the inventive system can also be easily retrofitted onto any existing snowplow equipment. For example, the upper and lower rotation bearings 14 and 15 can be easily welded or bolted via brackets onto the existing snowplow blade 4. The shaft 11 may be a single continuous shaft member that extends continuously from top to bottom, or may comprise an upper shaft stub protruding upwardly from the choke plate 10 and a lower shaft stub protruding downwardly from the choke plate 10. The plate 10 is preferably welded to the shaft 10, but may be connected in any suitable manner.

The choke plate 10 is preferably configured rotationally symmetrically about the choke plate shaft 11, with two opposite coplanar vanes on opposite sides of the shaft, terminating along two opposite curved edges 10A that are substantially matched radially inwardly to the curvature of the front face of the snowplow blade body 4A, so as to leave only a small (e.g. 0.125 to 0.5 inch) uniform clearance gap 13 between the respective choke plate edge 10A and the front face of the plow blade body 4A. The choke plate edges 10A are preferably provided on plastic choke plate edge members 12 that are mounted on the choke plate 10 itself. The choke plate 10 is preferably made of metal for strength and economy, but the plastic choke plate edge members 12 allow a close conforming fit of the choke plate edges 10A to the curvature of the surface of the plow blade body 4A, without binding or causing damage to the plow blade by scraping of metal against metal. The plastic choke plate edge members 12 are preferably replaceable, because they will become worn over time. Additionally, it is optionally possible to provide a rubber or leather seal member along the choke plate edges 10A and/or along the curved front face of the plow blade body 4A in order to achieve a tighter seal of the choke plate 10 to the plow blade body 4A. Instead of the symmetrical configuration, the choke plate may be one-sided, i.e. have only a single plate vane extending from one side of the shaft.

Preferably the top end (but alternatively the bottom end) of the choke plate shaft 11 is connected to a rotational actuator 17, e.g. a hydraulic motor or an electric motor with a suitable reduction gearing for rotationally driving the choke plate shaft 11 and therewith the choke plate 10. The rotation direction in the example embodiment of FIG. 1 is preferably counterclockwise as viewed from the top, for example as indicated by the rotation arrow 18 in FIGS. 2 and 3. Instead of the preferred continuous or full rotation in the single consistent rotation direction 18, the rotational actuator and the shaft and choke plate can undergo only a partial rotation, e.g. an oscillating pivoting "rotation" back-and-forth by one quarter turn. Thus, the rotational actuator can be any actuator mechanism that can produce at least a partial rotational pivoting about the axis of the shaft, e.g. a linear piston driving the shaft via a torque lever arm. But preferably the actuator is a full rotational motor such as an electric or hydraulic motor.

Figure 2:
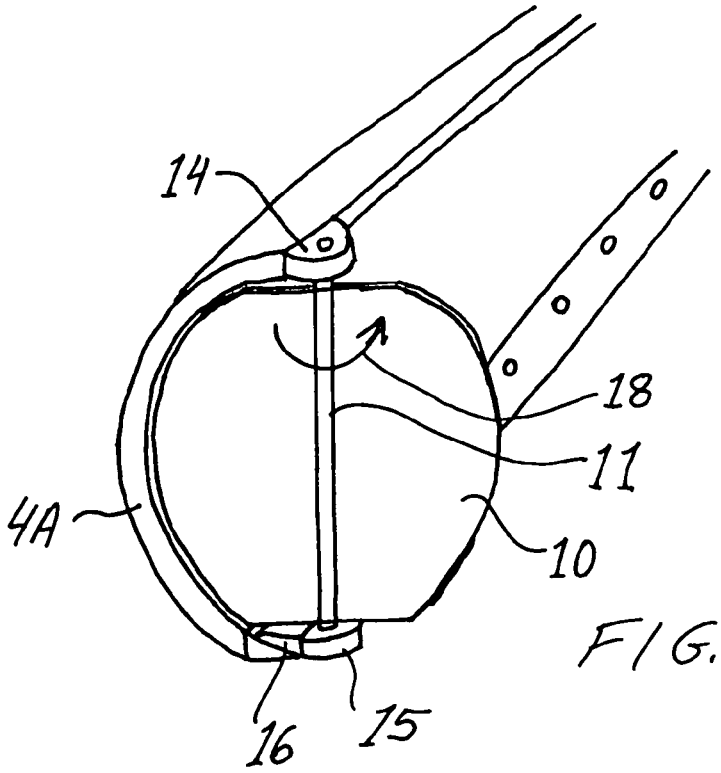
FIG. 2 is a schematic perspective view of a snow discharge choke plate of the inventive system of FIG. 1, in a closed position of the choke plate so as to block the discharge of snow.

When the choke plate 10 is rotated to the closed position shown in FIGS. 1 and 2, the choke plate will block the discharge of snow from the discharge end (e.g. the right end) of the snowplow blade 4. "Blocking" the discharge of snow does not mean entirely preventing the discharge of any snow past the choke plate, but rather means impeding the discharge of snow and preventing the discharge of the majority of snow that is cast to the discharge end of the plow while some snow will leak or spill past the choke plate. Thus, the snow being collected and cast toward the right along the angled plow blade 4 will be blocked by the choke plate 10 and caused to accumulate in front of the plow blade body 4A as the plow truck 3 continues to drive forwardly. Depending on the size of the choke plate 10, a substantial amount of snow can be accumulated in front of the plow blade 4A, until the snow starts spilling laterally outwardly (to the right) from the forward choke plate edge 10A. The lateral width of the choke plate 10 can be designed as desired, depending on the placement and positioning of the choke plate shaft 11 forwardly from the rear plane of the plow face of the plow blade body 4A. Namely, the farther the shaft 11 is positioned forwardly of the plow blade body 4A, the larger the width of the choke plate 10 will be. This position of the shaft 11 can be selected or designed as desired by providing appropriately sized brackets for mounting the upper and lower rotation bearings 14 and 15. Depending on the size and shape of the snowplow blade body 4A, it is alternatively possible to mount the choke plate shaft so that it extends through holes in the plow blade body 4A itself, as will be discussed below in connection with FIG. 4.

Figure 5:
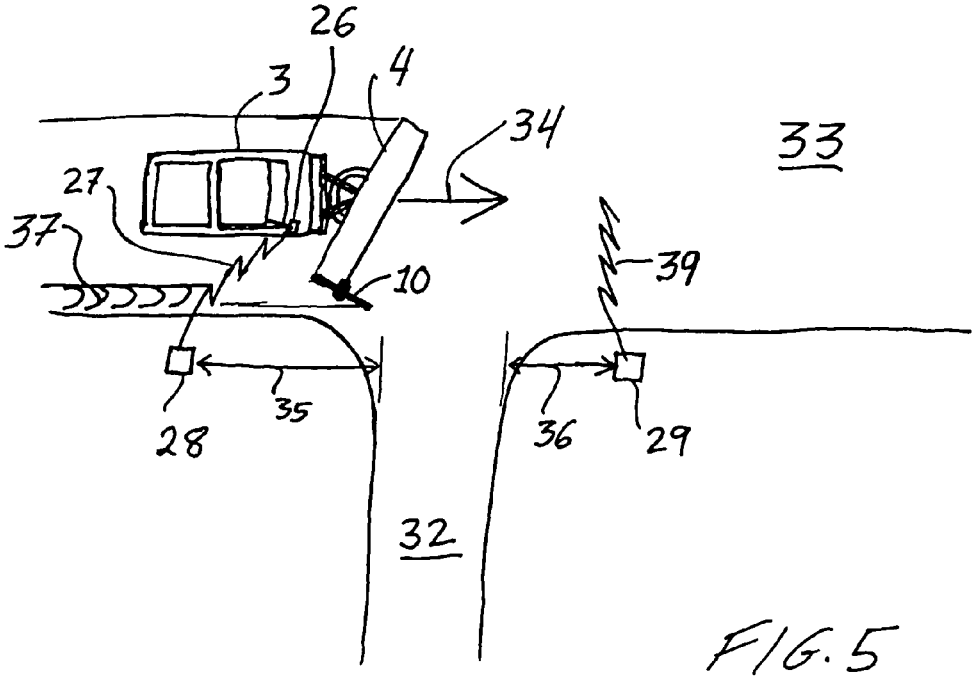
FIG. 5 is a schematic top plan view of a snowplow truck equipped with an embodiment of the inventive system, as the snowplow truck plows a main road passing by a junction of a driveway or side road.

In the closed position represented in FIGS. 1 and 2, the choke plate 10 may extend substantially perpendicularly to the longitudinal axis or plane of the snowplow blade 4, for example as also represented in the top view of FIG. 5. However, as can be seen in FIG. 5, if the choke plate shaft 11 is mounted at or near the discharge end of the snowplow blade 4, and the choke plate 10 extends perpendicularly to the lengthwise axis or plane of the plow blade 4, then the forward portion of the choke plate 10 will extend laterally outwardly beyond the swath or width-of-cut of the angled plow blade 4, and thereby cause the collection and accumulation of additional snow on and in front of the choke plate 10 and the plow blade 4. That can be a beneficial feature in order to not only block the discharge of a snowbank or ridge of snow while passing a driveway or the like, but actually to remove additional snow from the mouth of such a driveway. Alternatively, if such a feature is not desired, then the choke plate 10 is arranged so that it takes up its closed position when the choke plate 10 extends forwardly parallel to the forward travel 34 of the plow truck 3 (see direction arrow 34 in FIG. 5), rather than perpendicularly to the plow blade 4. To achieve that, the choke plate shaft 11 must be mounted somewhat inwardly or inboard from the discharge end of the plow blade 4. A further alternative is to mount the choke plate shaft 11 inwardly away from the discharge end of the plow blade 4, but to have the choke plate 10 extend perpendicularly to the longitudinal axis of the plow blade 4 when the choke plate 10 is in its closed position. Thereby, even with the choke plate 10 extending perpendicularly from the plow blade 4, the forward edge of the choke plate 10 can be positioned to be laterally in line with, e.g. straight in front of, the outer edge of the discharge end of the plow blade 4, so that the choke plate 10 does not collect and accumulate snow from a wider swath than the plow blade 4 itself does. Thus, in general, the choke plate 10 in its closed position is oriented substantially perpendicular, e.g. perpendicular +/−30°, to the longitudinal axis of the plow blade 4, which is taken as extending parallel to the plow edges 4C and 4D.

After the snowplow has passed by a side street or driveway, so that it is desired to again discharge snow from the plow blade 4, then the choke plate 10 is rotated from the closed position shown in FIG. 2 to the open position shown in FIG.

Figure 3:
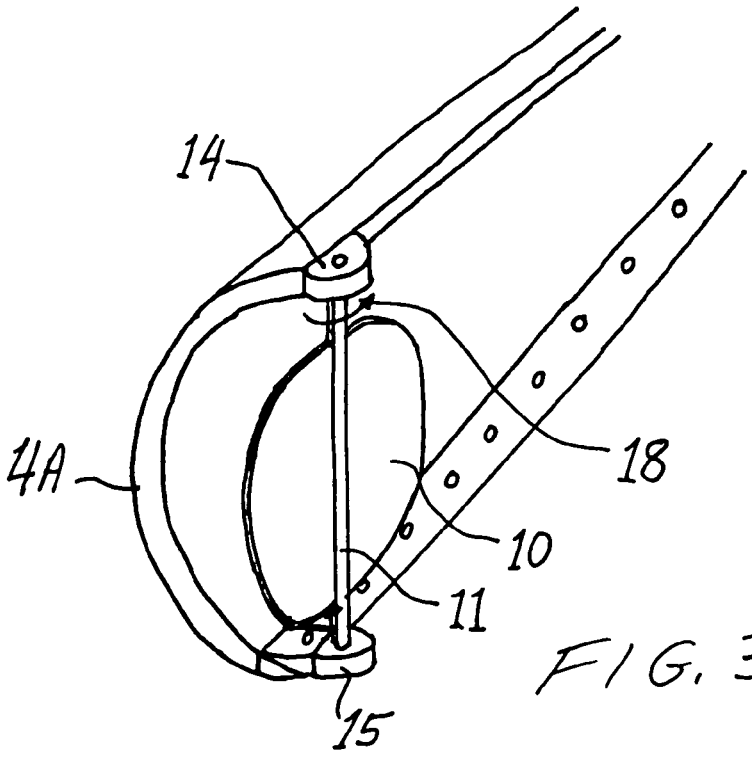
FIG. 3 is a schematic perspective view similar to FIG. 2, but showing the choke plate in an open position so as to allow the discharge of snow.

3, for example preferably by a 90° or quarter-turn rotation in the counterclockwise direction as shown by rotation arrow 18 in FIGS. 2 and 3. Then, in the open position of the choke plate 10 as shown in FIG. 3, with the choke plate 10 extending preferably parallel (or at least substantially parallel) to the longitudinal axis of the plow blade 4, snow can be freely discharged and cast from the discharge end of the snowplow blade body 4A. Thus, the open position shown in FIG. 3 is the usual position of the choke plate 10 during the normal plowing operation of the snowplow 4. Because the choke plate 10 extends parallel to the longitudinal axis or plane of the snowplow blade 4 (e.g. parallel to the plow bottom edge 4C and the plow top edge 4D), therefore the choke plate 10 does not impede the casting of snow along the plow blade body 4A and the discharging of snow from the discharge end of the plow blade body 4A. Only when the snowplow passes a side road or driveway, or some other situation arises in which the discharge of snow from the plow blade is to be temporarily blocked, then the choke plate 10 is rotated, preferably counterclockwise by a quarter-turn, from the open position shown in FIG. 3 to the closed position shown in FIG. 2.

As described above, the preferred rotational actuator 17 simply needs to carry out quarter-turn rotations in the counterclockwise direction to successively switch the choke plate 10 from the open position, to the closed position, then again to the open position, then again to the closed position, etc. To ensure that the choke plate 10 stops exactly at the correct open or closed position, the system may further include detents on the plow blade body and/or on the rotation bearing mounting brackets so as to detent the rotation at the proper positions. Alternatively, the system can additionally include one or more sensors that sense the exact rotational position of the choke plate 10 and/or the shaft 11 and then adjust the rotation of the rotational actuator 17 accordingly to ensure proper positioning of the choke plate. Also, the rotational actuator 17 can incorporate a stepper motor that provides defined quarter-turn steps of the choke plate through the suitable gear train.

As mentioned above, in a further alternative, rather than successive full-revolution rotation, the rotational actuator 17 may merely provide a quarter-turn rotation in the counterclockwise direction to move the choke plate from the closed position to the open position, and then a quarter-turn rotation in the clockwise direction to turn the choke plate 10 from the open position to the closed position. In any event, because the choke plate is preferably configured symmetrically about the axis of the choke plate shaft 11, therefore the pressure of any snow accumulating and pressing on the choke plate 10 will have a substantially balanced force application on the choke plate 10 on both sides of the shaft 11, so that the amount of force required to rotate the shaft 11 and the choke plate 10 is reduced. The choke plate 10 is thus preferably configured and arranged in the manner of a butterfly valve.

Figure 4:
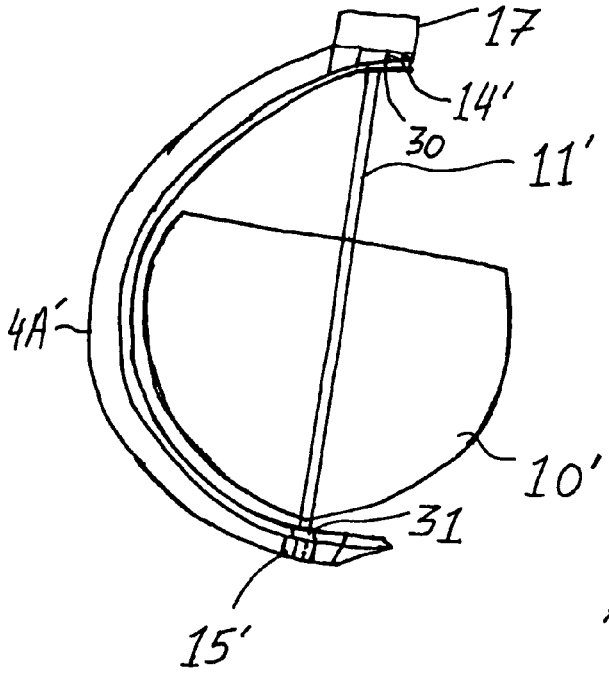
FIG. 4 is a schematic side view of components of a second embodiment of the inventive system mounted on a different snowplow blade.

FIG. 4 shows an alternative embodiment of a choke plate 10' carried on a choke plate shaft 11'. In this embodiment, the choke plate 10' has a height less than the height of the plow blade body 4A', and the upper end of the shaft 11' passes through a hole 30 in the upper forward part of the plow blade body 4A' to be rotationally supported in the upper rotation bearing 14', while the lower end of the shaft 11' extends through a hole 31 in the lower forward part of the plow blade body 4A' to be supported in the lower rotation bearing 15'. In comparison to the embodiment of FIGS. 1, 2 and 3, this embodiment of FIG. 4 requires holes 30 and 31 to be bored through the plow blade body 4A', but it allows mounting the rotation bearings 14' and 15' directly on the structurally reinforced plow blade body 4A', thereby avoiding or minimizing the need for mounting brackets to mount the rotation bearings 14' and 15'.

Also, this arrangement allows the size and the tilt angle of the choke plate 10' to be selected or designed as desired. Namely, the size of the choke plate 10' can be reduced by moving the shaft 11' rearwardly, or increased by moving the shaft 11' forwardly. While the shaft 11 shown in FIGS. 1, 2 and 3 extends substantially vertically, the shaft 11' may instead be tilted at an angle as shown in FIG. 4, e.g. within a range of +/−20° from vertical, for example depending on the configuration and tilt angle of the plow blade body 4A' between the upper edge and lower edge thereof. The curvature shape of some snowplows makes a vertical shaft 11 unsuitable, because then the bottom portion of the choke plate would come to an acute vertex, and thus allow less snow accumulation. Tilting the shaft 11' forwardly as shown in FIG. 4 allows the bottom vertex of the choke plate 10' to be made broader. It must be ensured, however, that the forward extending portion of the choke plate 10' does not extend downwardly below the plow bottom edge 4C. The forward tilt angle of the shaft is determined by the positions of the upper and lower bearings, but generally, the upper and lower bearings are respectively connected to the upper half and the lower half of the plow blade. Preferably, the center of the choke plate shaft 11 or 11' is located in the forward half of the maximum fore-and-aft extent of the snowplow blade 4. Namely, the center of the shaft 11 or 11' will be located at least halfway from the rearmost extent of the plow blade 4 to the forwardmost extent of the plow blade 4 as seen on a section plane normal to the plow bottom edge 4C and the plow top edge 4D or on a section plane extending in the travel direction 34 of the plow truck 3. More preferably, the shaft 11 or 11' is rotatably connected to the plow blade 4 at or proximate to the plow bottom edge 4C and the plow top edge 4D, preferably within a small distance of these edges, either somewhat forward of these edges as shown in FIGS. 2 and 3, or somewhat behind these edges as shown in FIG. 4. The preferred range of this position relative to the plow edges 4C and 4D is within one third or preferably one quarter of the total fore-and-aft depth of the plow blade 4. Most preferably in many applications, for the greatest simplicity, the shaft 11 is rotatably supported in the rotation bearings 14 and 15 that are simply bolted onto the plow top edge 4D and the plow bottom edge 4C either directly or via mounting brackets.

Referring again to FIG. 1, it can be seen that the snowplow discharge control system 1 further includes a controller 20 connected by an actuator control line 19 to the rotational actuator 17. The control line 19 may, for example, be an electric power cable, an electric control signal cable, a set of feed and return hydraulic hoses, a mechanical linkage, or the like, depending on the particular embodiment of the rotational actuator 17. The controller 20 accordingly incorporates hydraulic valves or electrical control switches or a mechanical actuator, as well as preferably an electronic control circuit and/or a computer processor.

The controller 20 receives an input from a manual control switch 24 mounted in the cab (e.g. on the dashboard) of the plow truck 3 via a manual control signal line 25. The manual control switch 24 enables the driver of the plow truck 3, via the controller 20, to manually activate the rotational actuator 17 to switch the choke plate 10 from the open position to the closed position, and vice versa. In one simple form, the manual control switch 24 may be a lever actuating a hydraulic control valve in the controller 20 in order to appropriately direct pressurized hydraulic fluid via the actuator control line 19 to a hydraulic motor of the rotational actuator 17, to switch the choke plate 10 as desired between the open and closed positions. Alternatively, in another simple form, the manual control switch 24 may be an electrical switch that acts via a relay in the controller 20 to send electrical power via the control line 19 to an electric motor as the rotational actuator 17 so as to switch the choke plate 10 between the open and closed positions. Alternatively, the controller 20 includes an electronic control circuit and/or a computer processor receiving control inputs to then correspondingly actuate and control the rotational actuator 17.

The controller 20 further preferably receives an input from an external wireless signal receiver or transponder 26 via an external signal line 38. The external signal receiver or transponder 26 is mounted on the plow truck 3 and/or at least includes an antenna that is effective at receiving and optionally transmitting wireless signals externally from the plow truck 3. The external wireless signal receiver or transponder 26 receives a wireless actuation signal 27 and 39 from at least one external wireless signal transmitter or transponder 28 and 29, to automatically actuate the closing or opening of the choke plate 10, as will be described below in connection with FIG. 5.

As a further option, the controller 20 includes a speed-dependent timer circuit 21 that receives a vehicle speed signal via a signal line 23 from a speed pickup 22. For example, the speed pickup 22 can obtain a signal indicative of the plow truck's travel speed from the same source as the speed signal provided to the plow truck's speedometer. This speed information, along with a speed-dependent timer signal from the timer 21, is used by the controller 20 to automatically determine when to switch the choke plate 10 from the closed position to the open position after the choke plate 10 had been closed based on a manual input from the manual control switch 24 or based on an external wireless signal received by the external wireless signal receiver 26. For example, if the plow vehicle is to plow past a driveway with the choke plate 10 closed and then re-open the choke plate 10 after passing the driveway, the closing of the choke plate 10 is triggered by the manual switch 24 or the external wireless signal 27 received by the receiver 26, and thereafter the choke plate will be opened again automatically a certain amount of time later, depending on the travel speed of the plow truck 3. For example, if the plow truck 3 is traveling at 20 miles per hour, the controller 20 may cause the choke plate 10 to open again at a delay time of 2 seconds after the switch 24 or receiver 26 caused the choke plate to close, whereby the plow truck will have traveled about 60 feet from the point of closing the choke plate to the point of opening the choke plate, which allows for a 60-foot long gap of the discharge snowbank, e.g. including a 20-foot wide driveway mouth, a 20-foot gap before the driveway, and a further 20-foot gap after the driveway. The size of the gap in the discharge snowbank can be selected, and then the appropriate duration of the closure of the choke plate is automatically determined by the controller 20 with the speed-dependent timer 21, depending on the vehicle speed as indicated by the speed pickup 22.

FIG. 5 is a schematic top plan view or aerial view demonstrating the operation of the inventive snowplow discharge control system 1 in combination with the snowplow 4 mounted on the plow truck 3, as the plow truck 3 drives in the travel direction 34 along a main road 33, in order to plow snow from the road. As the truck 3 drives forward 34, the plow blade 4 intercepts and gathers snow and casts it toward the right, thus discharging the snow from the right discharge end of the plow blade 4 and forming a continuous snowbank or ridge 37 of the discharged snow. In order to temporarily block the discharge of snow from the plow blade 4, the choke plate 10 is moved from the open position (e.g. as shown in FIG. 3) to the closed position (e.g. as shown in FIG. 2), preferably by rotating the choke plate 10 one quarter turn counterclockwise. Thus, as the plow truck 3 passes by the driveway 32, no snow is discharged from the plow blade 4, but rather the snow accumulates on the plow blade 4 and the choke plate 10 and is pushed ahead of the plow truck 3. Thus, no snowbank or ridge 37 of discharged snow forms across the mouth of the driveway 32. Once the truck 3 has passed sufficiently beyond the driveway 32, then the choke plate 10 is rotated a further quarter turn counterclockwise from the closed position to the open position. Thus, the snow accumulated on the plow blade 4 will now be discharged, and the plow blade 4 will then continue forming a snowbank 37 as it discharges further plowed snow from its discharge end.

The opening and closing of the choke plate 10 in order to interrupt the discharging of snow as the plow blade 4 crosses the mouth of a driveway 32 can be controlled in various ways via the controller 20 as described above. Most simply, the driver of the plow truck 3 decides when to open and close the choke plate 10, and correspondingly manually switches the manual control switch 24 in the cab of the plow truck. This manual switching can actuate both the opening and the closing of the choke plate 10. Alternatively, once the choke plate 10 has been opened, the closing thereof can be actuated automatically based on a speed-dependent timer signal using the speed pickup 22 and the timer 21 as discussed above in connection with FIG. 1.

A further alternative for actuating the choke plate 10 to the closed position is with an external wireless signal transmitter or transponder 28 that communicates via a wireless signal 27 with the external wireless signal receiver or transponder 26 provided on the plow truck 3. The external wireless signal transmitter or transponder 28 provides any type of wireless signal 27, such as a radio frequency (RF) signal or an infrared (IR) signal 27. The transmitter or transponder 28 is stationarily mounted at a fixed ground-based position outside of and separate from the plow truck 3, for example on a small post or stake alongside the roadway 33 at the location upstream from the driveway 32 at which the choke plate 10 is to be closed. The transmitter or transponder 28 could alternatively be mounted on a house or other structure, as long as the signal strength and transmission distance of the signal 27 is sufficient, and the signal can be sufficiently focused to designate the proper location for closing the choke plate 10. The transmitter 28 may constantly emit an appropriate wireless signal 27 (e.g. an RF signal or an IR signal) that is recognized by the signal receiver 26 of any passing plow truck 3 as a signal to close the choke plate 10. In this regard, the transmitter 28 can use technologies similar to an RF garage door opener transmitter or an IR television remote control, except that the signal is constantly emitted. Alternatively, the unit 28 may be a transponder that first receives a challenge or interrogation signal that is constantly or successively repeatedly transmitted by the signal transponder 26 of the plow truck 3. In response and reply to the challenge or interrogation signal from the truck's transponder 26, the ground-based transponder 28 emits a reply signal 27 that calls for closing the choke plate 10. The signal 27 can be an active emission, or simply a modulated backscattering of the signal emitted by the truck's transponder 26. The unit 28 can be provided with its own self-contained power supply, such as a battery or a suitable power source connected to utility line power. Alternatively, the transponder unit 28 can extract its required power from the field of the signal emitted by the truck's transponder 26, which is preferably powered from the truck's electrical system. Thus, for example, the transponder 28 can utilize technology found in today's "smart" unlocking and ignition systems of motor vehicles. The term "transmitter" herein covers both pure transmitters with only a transmit capability, as well as transponders with a transmit and receive capability.

Once the choke plate 10 has been closed based on the automatic signal provided by the transmitter or transponder unit 28, it may again be opened by the speed-dependent timer 21 as discussed above, or by another corresponding RF or IR signal 39 provided by a second external wireless signal transmitter or transponder 29 located a suitable distance downstream from or after the driveway 32. The transmitter or transponder unit 29 operates like the transmitter or transponder unit 28, except that the unit 29 emits an opening signal 39 that triggers the choke plate to open, while the unit 28 emits a closing signal 27 that triggers the choke plate 10 to close.

The distance 35 before or upstream from the driveway 32 at which the choke plate shall close, and the distance 36 after or downstream from the driveway 32 at which the choke plate 10 shall again open, are each variably selectable simply by appropriately positioning the units 28 and 29, as desired by the homeowner or by the service that performs the plowing. The distances 35 and 36 are preferably selected within a range from 3 feet to 20 feet. The shorter distance provides merely minimal avoidance of the snowbank across the mouth of the driveway 32 while minimizing the accumulation of snow while the choke plate is closed, while the larger distance provides easier, safer driving access to the driveway and improved visibility at the mouth of the driveway. However, the larger distance causes a greater accumulation of snow ahead of the plow blade 4 while the choke plate 10 is closed, which could overwhelm the snowplow if a large snowfall accumulation is being plowed, and also causes a larger amount of snow to be dumped in a larger snowpile or snowbank once the choke plate 10 opens after passing by the driveway 32.

The transmitter or transponder units 28 and 29 are, for example, provided by the plowing service or municipality that performs the snowplowing on the road 33. Thereby, the units 28 and 29 will be suitable for communicating with the signal receiver or transponder 26 provided on the plow truck 3. The units 28 and 29 may be provided as a no-cost benefit of the plowing service, or added as an upcharge option for the plowing service, or paid along with the snowplowing from the municipal tax revenues, or rented by the municipality or plowing service to the homeowner who wants the extra benefit of automatically avoiding the dumping of a discharge snowbank across the mouth of his or her driveway.

The manual control switch 24 in the cab of the plow truck 3 can also override the automatic signals provided by the external signal transmitter or transponder units 28 and 29. Thus, ultimate control of the snowplow discharge control system 1 remains in the hands of the plow operator, so that he or she can keep the choke plate 10 open even if an external transmitter is calling for the choke plate to be closed, or keep the choke plate closed even if an external transmitter 29 is calling for the choke plate to be opened.

While the drawings represent a single choke plate arranged on only one end of the plow blade 4 (the right primary discharge end), it is also possible to arrange another similar choke plate mounted on a shaft that is rotationally driven by another rotational actuator at the other end of the plow blade if the plow blade is capable of tilting to either side. In that case, the same control inputs described above can be used to simultaneously actuate both choke plates at both ends of the plow, or a second manual control switch can be provided for the other choke plate on the left end of the plow blade. It is also possible to provide three or more choke plates distributed along the length of the plow blade to achieve a staged blocking and accumulation of the snow along the plow blade, rather than merely blocking and accumulating snow at one or both ends of the plow blade.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims. The abstract of the disclosure does not define or limit the claimed invention, but rather merely abstracts certain features disclosed in the application.

What is claimed is:

1. A snowplowing system comprising a snowplow blade, and a fully rotatable choke plate mounted on a choke plate shaft extending along a plane of said choke plate at a discharge end of said snowplow blade, wherein said choke plate shaft extends vertically +/−20°, and wherein said choke plate is rotatable through complete rotations in a single consistent rotation direction, and is adapted for blocking discharge of snow from said discharge end when said choke plate is in a first rotational position and allowing discharge of snow from said discharge end when said choke plate is in a second rotational position.

2. The snowplowing system according to claim 1, wherein said first and second rotational positions are rotationally offset from one another respectively successively by one quarter turn in a single consistent rotation direction such that one complete rotation of said choke plate in said single consistent rotation direction provides two of said first rotational positions respectively alternating with two of said second rotational positions.

3. The snowplowing system according to claim 1, further comprising a rotational actuator mechanically connected to said choke plate and adapted to rotate said choke plate successively selectively to said first rotational position and said second rotational position by successive partial-turn rotational steps in a single consistent rotation direction, and a controller that is connected for control signal transmission to said rotational actuator and that is adapted to control rotation of said rotational actuator to rotate said choke plate successively selectively to said first and second rotational positions.

4. The snowplowing system according to claim 3, further comprising a wireless signal receiver that is connected to said controller and that is adapted to receive a first external wireless signal which is adapted to cause said controller to control rotation of said rotational actuator to rotate said choke plate to said first rotational position, and a first wireless signal transmitter that is adapted to transmit said first exterior wireless signal and that is mounted stationarily beside a road which is to be plowed by said snowplow blade at a location upstream from an intersecting road or driveway relative to a plowing direction.

5. A snowplowing system comprising:

a snowplow blade having a snow discharge end;

a choke plate that extends surfacially along a choke plate plane and that is connected to and supported on a choke plate shaft extending along said choke plate plane, wherein an upper portion of said choke plate shaft is rotatably connected to an upper portion of said snowplow blade near said discharge end, a lower portion of said choke plate shaft is rotatably connected to a lower portion of said snowplow blade near said discharge end, said choke plate is rotationally symmetrical about said choke plate shaft and has two opposite free edges that each respectively have a curvature which radially inwardly follows along a sectional curvature of said snowplow blade, and said choke plate on said choke plate shaft is selectively rotatable to a first rotational position in which said choke plate plane extends substantially perpendicular to a longitudinal axis of said snowplow blade and to a second rotational position in which said choke plate plane extends substantially parallel to said longitudinal axis of said snowplow blade; and a rotational actuator that is mechanically connected to said upper portion or said lower portion of said choke plate shaft, and that is adapted to rotate said choke plate successively selectively to said first rotational position and said second rotational position.

6. The snowplowing system according to claim 5, wherein said first and second rotational positions are rotationally offset from one another respectively successively by one quarter turn in a single consistent rotation direction.

7. The snowplowing system according to claim 5, wherein said choke plate comprises a metal plate body and plastic edge members along said two opposite free edges.

8. The snowplowing system according to claim 5, wherein said choke plate shaft extends vertically +/−20°.

9. The snowplowing system according to claim 5, further comprising a first rotation bearing that rotatably supports said upper portion of said choke plate shaft and that is connected to said upper portion of said snowplow blade, and a second rotation bearing that rotatably supports said lower portion of said choke plate shaft and that is connected to said lower portion of said snowplow blade.

10. The snowplowing system according to claim 9, wherein said first rotation bearing is arranged in front of an upper front edge of said snowplow blade, and/or wherein said second rotation bearing is arranged in front of a lower front edge of said snowplow blade.

11. The snowplowing system according to claim 9, wherein said first rotation bearing is arranged behind an upper front edge of said snowplow blade and said upper portion of said choke plate shaft extends through a first hole in said upper portion of said snowplow blade, and/or wherein said second rotation bearing is arranged behind a lower front edge of said snowplow blade and said lower portion of said choke plate shaft extends through a second hole in said lower portion of said snowplow blade.

12. The snowplowing system according to claim 5, further comprising a controller that is connected for control signal transmission to said rotational actuator and that is adapted to control rotation of said rotational actuator to rotate said choke plate successively selectively to said first and second rotational positions, and a manually operable switch that is connected to a first input of said controller.

13. The snowplowing system according to claim 12, further comprising a plow vehicle, wherein said snowplow blade is mounted to said vehicle, said manually operable switch is arranged in a cab or at a driver's station of said vehicle, and said controller comprises a speed-dependent timer arrangement that is arranged and adapted to pick up a signal indicative of a travel speed of said plow vehicle and to perform a timer countdown dependent on said travel speed.

14. The snowplowing system according to claim 12, further comprising a plow vehicle, wherein said snowplow blade is mounted to said vehicle, wherein said manually operable switch is arranged in a cab or at a driver's station of said vehicle, and further comprising a wireless signal receiver that is provided on said plow vehicle, connected to a second input of said controller and adapted to receive a first external wireless signal, and further comprising a first wireless signal transmitter that is adapted to transmit said first external wireless signal and that is mounted stationarily beside a road which is to be plowed by said snowplow blade at a first location upstream from an intersecting road or driveway relative to a plowing direction.

15. The snowplowing system according to claim 14, further comprising a second wireless signal transmitter that is adapted to transmit a second external wireless signal and that is mounted stationarily beside the road at a second location downstream from the intersecting road or driveway relative to said plowing direction, and wherein said wireless signal receiver is further adapted to receive said second external wireless signal.

* * * * *